US009907987B1

(12) United States Patent
Hossameldin et al.

(10) Patent No.: US 9,907,987 B1
(45) Date of Patent: Mar. 6, 2018

(54) SYSTEMS AND METHODS FOR SOUND WAVES FIRE EXTINGUISHERS

(71) Applicant: University of Dammam, Dammam (SA)

(72) Inventors: Hany Hossameldin, Dammam (SA); Abdullah Alkadi, Dammam (SA)

(73) Assignee: University of Dammam, Dammam (SA)

( * ) Notice: Subject to any disclaimer, the term of this patent is extended or adjusted under 35 U.S.C. 154(b) by 0 days.

(21) Appl. No.: 15/247,280

(22) Filed: Aug. 25, 2016

(51) Int. Cl.

| | |
|---|---|
| ***A62C 2/00*** | (2006.01) |
| ***A62C 37/40*** | (2006.01) |
| ***A62C 99/00*** | (2010.01) |
| ***A62C 37/36*** | (2006.01) |
| ***A62C 3/00*** | (2006.01) |

(52) U.S. Cl.
CPC ..... *A62C 37/40* (2013.01); *A62C 3/00* (2013.01); *A62C 37/36* (2013.01); *A62C 99/0009* (2013.01)

(58) Field of Classification Search
CPC ..... A62C 37/40; A62C 99/009; A62C 3/00; A62C 37/36
USPC ..... 169/43, 46, 54, 56, 60, 61, 70
See application file for complete search history.

(56) References Cited

U.S. PATENT DOCUMENTS

2007/0172801 A1* 7/2007 Darois ..... G09B 19/00 434/226

FOREIGN PATENT DOCUMENTS

| | | | |
|---|---|---|---|
| BR | PI705173-5 | A2 | 11/2009 |
| CN | 203870888 | U | 10/2014 |
| TW | 201002383 | A | 1/2010 |

OTHER PUBLICATIONS

Shaik Salauddin, et al., "Sound Fire Extinguishers in Space Stations", http://iceeot.org/papers/OR1103.pdf, Mar. 19, 2016, 4 pages.
"Meyer Sound Helps Mythbusters Master Flame in Apr. 11 Episode", http://www.meyersound.com/news/2007/mythbusters/, 2007, 1 page.

* cited by examiner

*Primary Examiner* — Steven J Ganey
(74) *Attorney, Agent, or Firm* — Oblon, McClelland, Maier & Neustadt, L.L.P.

(57) ABSTRACT

A fire extinguisher includes one or more sound waves fire extinguishers. Additionally, the fire extinguisher includes processing circuitry configured to receive output from one or more sensors, determine if a fire related event is detected based on the output from the one or more sensors, and activate the one or more sound waves fire extinguishers in response to detection of the fire related event to minimize the fire related event via mechanical pressure waves.

14 Claims, 8 Drawing Sheets

100

SYSTEMS AND METHODS FOR SOUND WAVES FIRE EXTINGUISHERS

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Typically, fire extinguishers try to extinguish a fire using various methods. For example, a fire extinguisher can interrupt the chemical reaction of a fire by smothering the fire. The fire can be smothered with dry chemicals, foams, water, carbon dioxide, and the like. However, fire is a plasma, and therefore, it can be manipulated with physical forces such as sound waves.

SUMMARY

The foregoing paragraphs have been provided by way of general introduction, and are not intended to limit the scope of the following claims. The described aspects, together with further advantages, will be best understood by reference to the following detailed description taken in conjunction with the accompanying drawings.

According to one or more aspects of the disclosed subject matter, a fire extinguisher includes one or more sound waves fire extinguishers. Additionally, the fire extinguisher includes processing circuitry configured to receive output from one or more sensors, determine if a fire related event is detected based on the output from the one or more sensors, and activate the one or more sound waves fire extinguishers in response to detection of the fire related event to minimize the fire related event via mechanical pressure waves.

The fire extinguisher can be aimed at a fire (or fire related event) to manipulate the fire with sound waves. The fire extinguishers can generate mechanical pressure waves that can cause vibrations in the medium (e.g., fire). The mechanical pressure waves have the potential to manipulate both burning material and the oxygen that surrounds it. Using the sound to separate the two, the fire can be starved of oxygen and extinguished.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
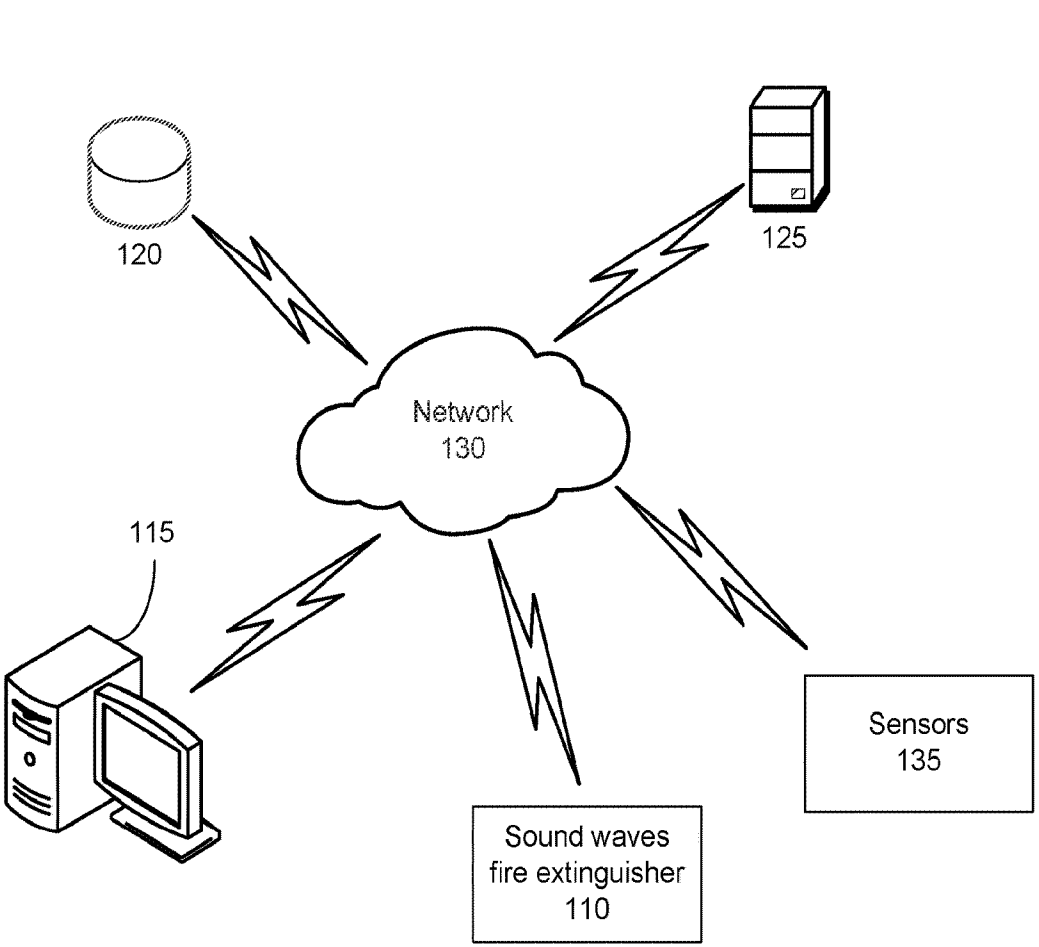
FIG. 1 depicts an exemplary schematic diagram of a sound waves fire extinguisher system according to one or more aspects of the disclosed subject matter.

The description set forth below in connection with the appended drawings is intended as a description of various aspects of the disclosed subject matter and is not necessarily intended to represent the only aspect(s). In certain instances, the description includes specific details for the purpose of providing an understanding of the disclosed subject matter. However, it will be apparent to those skilled in the art that aspects may be practiced without these specific details. In some instances, well-known structures and components may be shown in block diagram form in order to avoid obscuring the concepts of the disclosed subject matter.

Reference throughout the specification to "one aspect" or "an aspect" means that a particular feature, structure, characteristic, operation, or function described in connection with an aspect is included in at least one aspect of the disclosed subject matter. Thus, any appearance of the phrases "in one aspect" or "in an aspect" in the specification is not necessarily referring to the same aspect. Further, the particular features, structures, characteristics, operations, or functions may be combined in any suitable manner in one or more aspects. Further, it is intended that aspects of the disclosed subject matter can and do cover modifications and variations of the described aspects.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," and the like that may be used herein, merely describe points of reference and do not necessarily limit aspects of the disclosed subject matter to any particular orientation or configuration. Furthermore, terms such as "first," "second," "third," etc., merely identify one of a number of portions, components, points of reference, operations and/or functions as described herein, and likewise do not necessarily limit aspects of the disclosed subject matter to any particular configuration or orientation.

Referring now to the drawings, wherein like reference numerals designate identical or corresponding parts throughout the several views.

FIG. 1 depicts an exemplary schematic diagram of a sound waves fire extinguisher system (herein referred to as system 100) according to one or more aspects of the disclosed subject matter. The system 100 can include a sound waves fire extinguisher 110 (herein referred to as extinguisher 110). The extinguisher 110 can represent one or more extinguishers 110 connected to a computer 115, a database 120, a server 125, and sensors 135 via a network 130. The server 125 can represent one or more servers connected to the computer 115, the database 120, the sensors 135, and the extinguisher 110 via the network 130. The database 120 can represent one or more databases connected to the computer 115, the server 125, the sensors 135, and the extinguisher 110 via the network 130. The computer 115 can represent one or more computers connected to the database 120, the server 125, the sensors 135, and the extinguisher 110 via the network 130. The network 130 can represent one or more networks connecting the extinguisher 110, the computer 115, the database 120, the server 125, and the sensors 135.

The network 130 can be a public network, such as the Internet, or a private network such as an LAN or WAN network, or any combination thereof and can also include PSTN or ISDN sub-networks. The network 130 can also be wired, such as an Ethernet network, or can be wireless such as a cellular network including EDGE, 3G and 4G wireless cellular systems. The wireless network can also be Wi-Fi, Bluetooth, or any other wireless form of communication that is known.

The computer 115 can include an interface, such as a keyboard and/or mouse, allowing a user to input various specifications for operating the system 100, for example. Additionally, an extension of the computer 115 can include a smart phone, PDA, tablet, and the like which can operate as a remote device via Bluetooth, for example.

The database 120 (e.g., MySQL, Oracle, etc.) can store various information including specifications for the system 100 corresponding to input from the computer 115. For example, the database 120 can store the dimensions of the room in which the system 100 is installed, the position of objects in the room, and the like as further described herein. The database 120 can be internal to the server 125 or computer 115. In another aspect, the database 120 can be external.

The server 125 can include processing circuitry. The processing circuitry can carry out instructions to perform or cause performance of various functions, operations, steps or processes of the system 100. The processing circuitry can be configured to store information in memory, operate the system 100, receive and send information in the form of signal(s) from the at least one sensor 110, and the like. In other words, the server 125 can receive signals from the computer 115 and/or the sensors 135 to cause the server 125 to operate the system 100 as further described herein.

Figure 2:
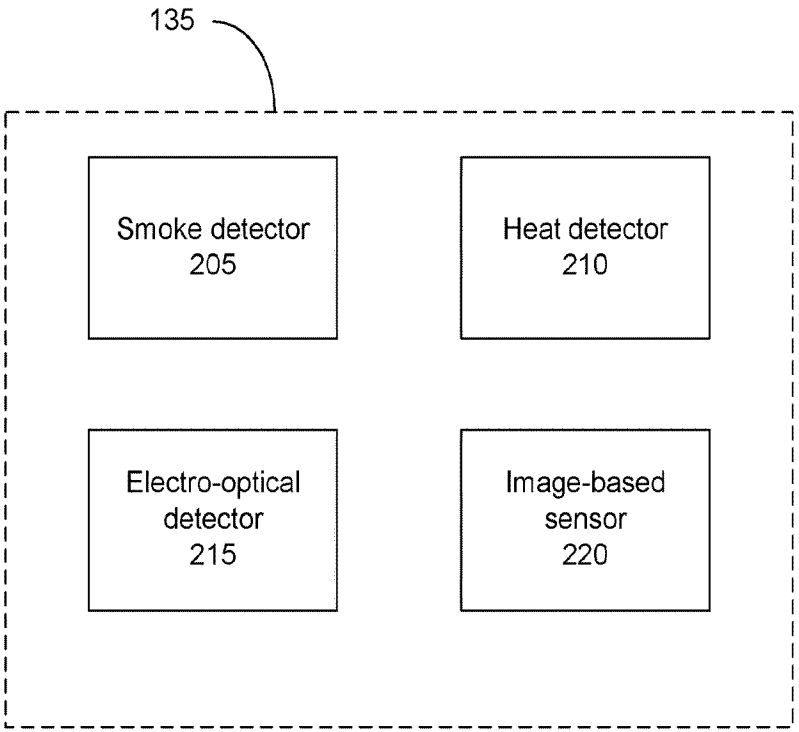
FIG. 2 depicts a block diagram of sensors for a sound waves fire extinguisher system according to one or more aspects of the disclosed subject matter.

FIG. 2 is a block diagram of the sensors 135 for the system 100 according to one or more aspects of the disclosed subject matter. The sensors 135 can include one or more of a smoke detector 205, a heat detector 210, an electro-optical detector 215, and an image-based sensor 220. One or more of each of the sensors 135 can be installed as part of the system 100 to detect any fire related event and transmit a signal corresponding to detecting the fire related event to the server 125. Additionally, the sensors 135 can receive signals from the server 125, the signals corresponding to detection of a fire, for example. The smoke detector 205 can detect smoke as part of the fire related event. An amount of smoke greater than a predetermined amount of smoke can cause the smoke detector 205 to transmit a signal corresponding to the detection of the fire related event. The heat detector 210 can be configured to transmit a signal in response to the fire related event increasing the temperature of a heat sensitive element in the heat detector 210. For example, when the heat detector 210 detects that the heat has met a predetermined temperature, the signal can be transmitted in response to the predetermined temperature having been met. The electro-optical detector 215 can be configured to detect the presence of a flame which is the visible portion of the fire related event. The electro-optical detector 215, such as the FS20X Multi-spectrum Flame Detector from National Fire Protection, can sense the optical radiant energy emitted by the flame of a fire. The image-based sensor 220, such as a camera, can be configured to detect a fire related event, such as flames or smoke. Alternatively, or additionally, the image-based sensor can identify humans and/or animals within an area in which the system 100 is installed as a further safety measure.

Figure 3A:
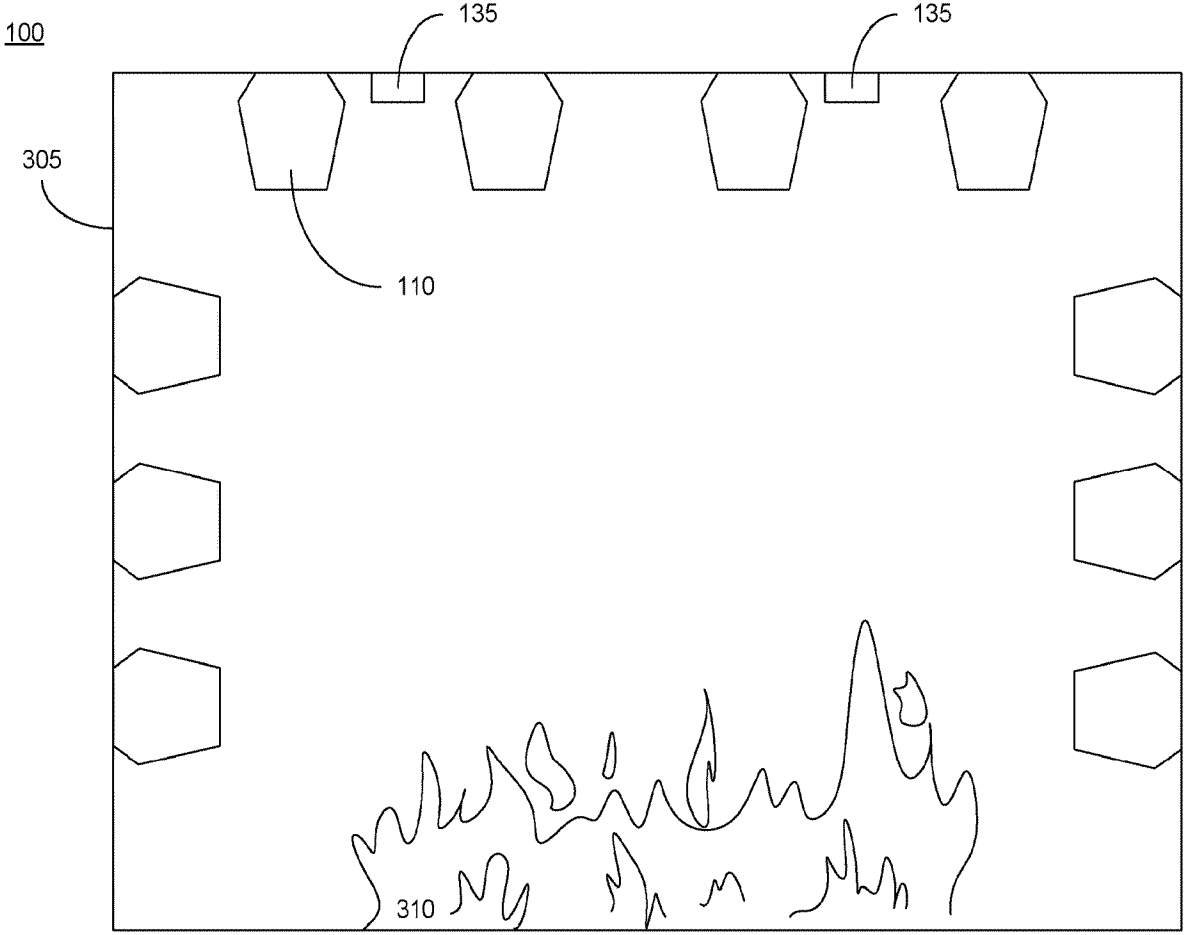
FIG. 3A is a perspective view of a sound waves fire extinguisher system according to one or more aspects of the disclosed subject matter.

FIG. 3A is a perspective view of the system 100 according to one or more aspects of the disclosed subject matter. The system 100 can be installed in an area 305. The area 305 can include one or more extinguishers 110 attached to one or more of the walls and/or ceiling of the area 305. Additionally, one or more sensors 135 can be installed in one or more of the walls, floor, and/or ceiling of the area 305 to detect any fire related event 310. The fire related event 310 can be smoke, heat, flames, and the like.

Figure 3B:
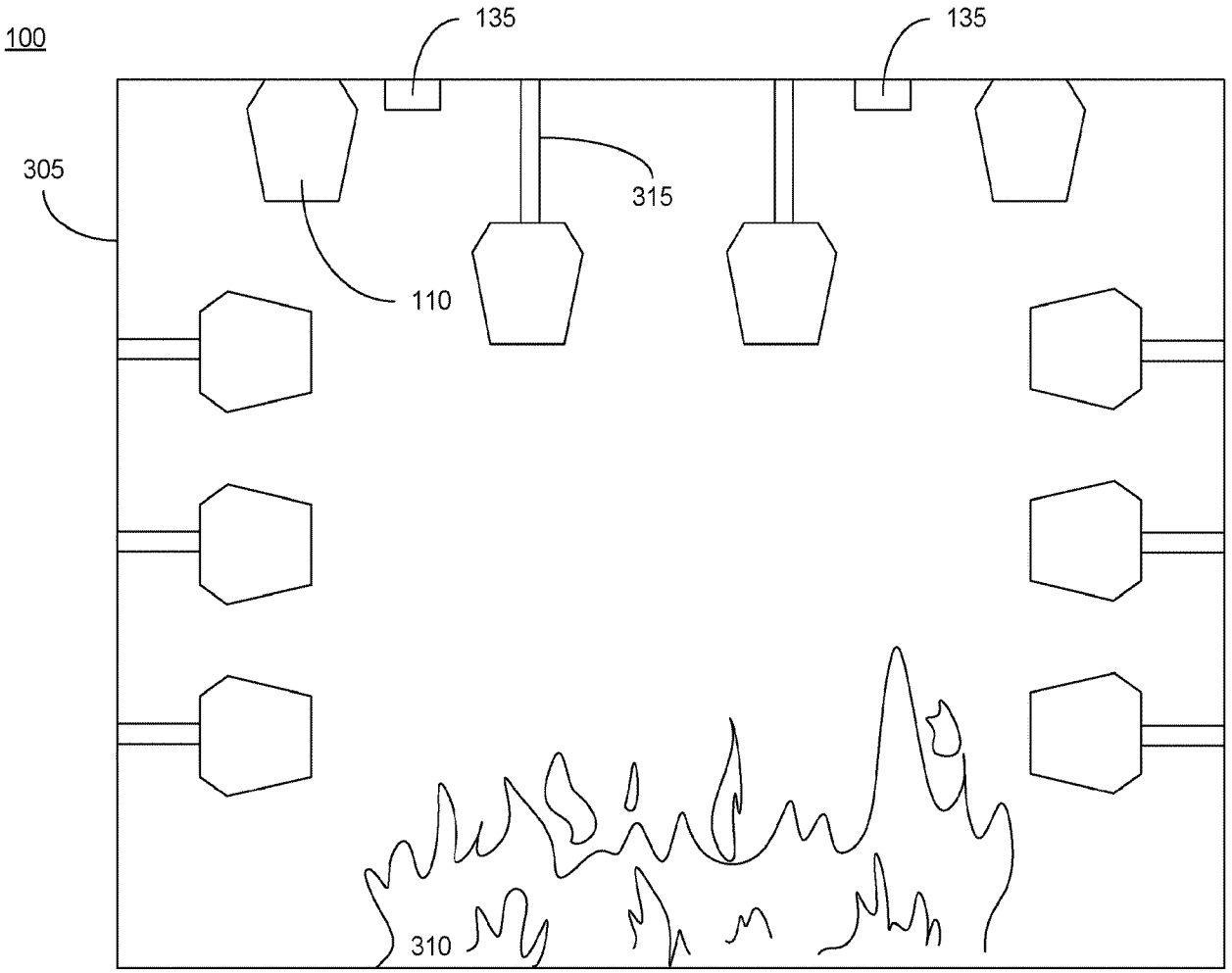
FIG. 3B is a perspective view of a sound waves fire extinguisher system according to one or more aspects of the disclosed subject matter.

FIG. 3B is a perspective view of the system 100 with one or more extinguishers 110 extended via extinguisher arms 315 according to one or more aspects of the disclosed subject matter. Each of the one or more extinguishers 110 can include an extinguisher arm 315 that attaches the extinguisher 100 to one or more of the walls and/or ceiling of the area 305. The extinguisher arm 315 of each of the extinguishers 110 can extend, telescopically, for example, toward the fire related event 310. Each extinguisher arm 315 can extend a predetermined amount based on the position of the extinguisher 110 within the area 305 and based on the position of the fire related event 310 within the area 305. It could be considered that not all of the one or more extinguishers 110 installed in the area 305 as part of the system 100 need to change position via the attached extinguisher arm 315 for each fire related event 310. The predetermined amount of extension for an extinguisher arm 315 can be a distance optimized to most efficiently minimize the fire related event 310.

For example, the extinguisher 110 may be more effective closer to the fire related event 310. However, the system 100 may consider that a plurality of extinguishers 110 are available, and the position of the fire related event 310 may determine a first extinguisher on one wall to extend one meter such that the first extinguisher 110 is ten centimeters from the fire related event 310 while a second extinguisher 110 opposite the first extinguisher 110 extends four meters such that the second extinguisher 110 is ten centimeters from the fire related event 310 on a side of the fire related event 310 opposite the side of the first extinguisher 110. Alternatively, or additionally, a third extinguisher 110 can extend from the ceiling of the area 305 to be ten centimeters above the fire related event 310.

Figure 4:
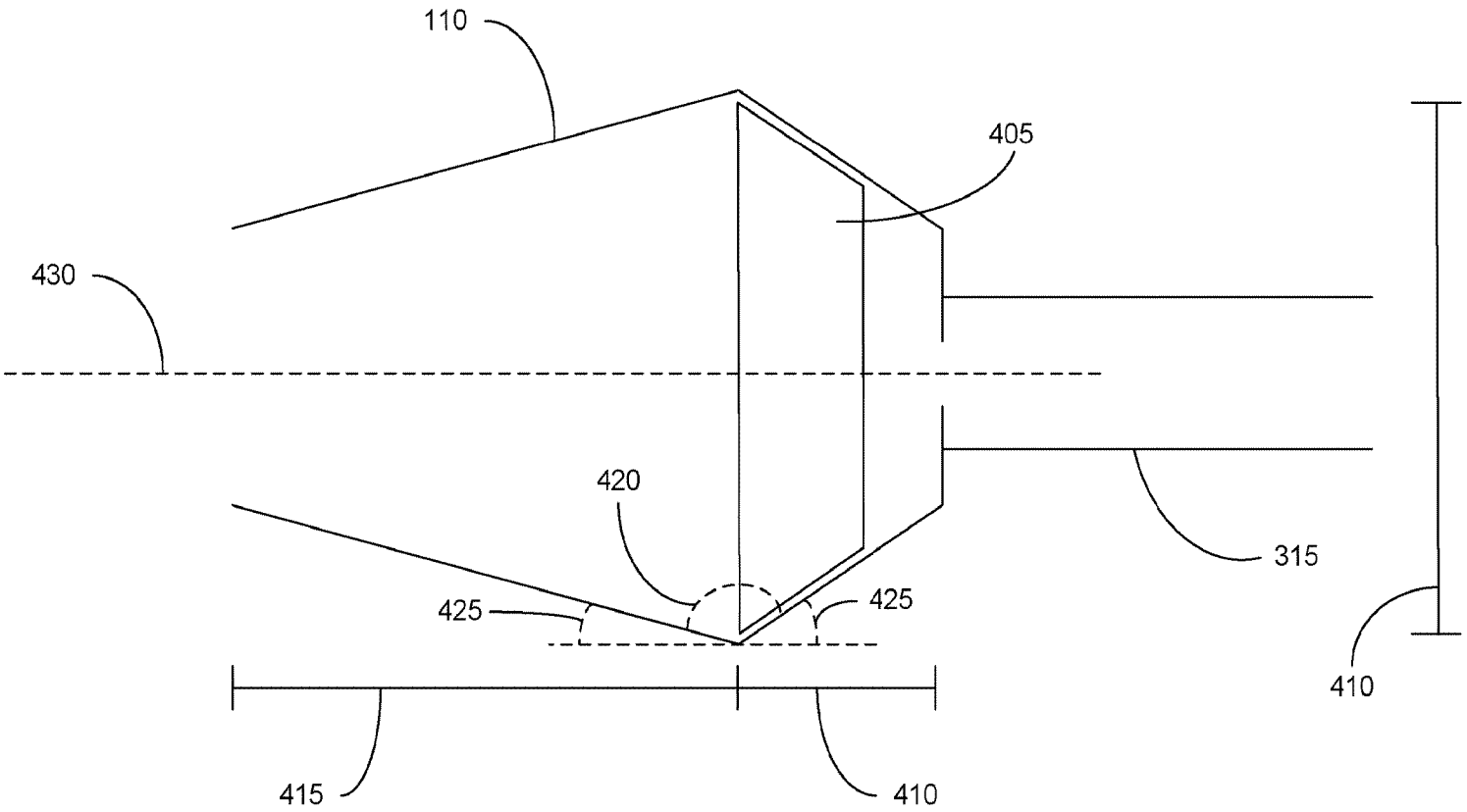
FIG. 4 is a perspective view of a sound waves fire extinguisher according to one or more aspects of the disclosed subject matter.

FIG. 4 is a perspective view of the extinguisher 110 according to one or more aspects of the disclosed subject matter. The extinguisher 110 can be attached to one or more of the walls and/or ceiling of the area 305 via extinguisher arm 315. The extinguisher 110 can also include a speaker 405. In one aspect, the speaker 405 can be communicably coupled to a remote device, such as the remote device described in FIG. 2. The remote device can control the speaker 405 wirelessly, via Bluetooth, for example.

In combination with specific dimensions of the extinguisher 110, the speaker can be installed in a position to direct sound through a circular orifice in the extinguisher 110 to radiate the sound evenly in the direction in which the extinguisher 110 is aiming. The circular orifice can be positioned opposite the speaker 405 and the sound from the speaker 405 can be directed toward the circular orifice. The speaker 405 can play a predetermined sound at a predetermined frequency. For example, the predetermined sound can be a plurality of human voices recorded in an anechoic chamber. The plurality of voices can be recorded creating various sounds, such as speaking Arabic phrases. The predetermined frequency can be 125 Hz which was determined via experimentation to create the fastest wind speed when playing the plurality of voices recorded in the anechoic chamber. However, a range of frequencies may be used. For example, a plurality of frequencies can be used in combination. In one aspect, each of the plurality of frequencies can be from 85 Hz to 180 Hz, which is the range of a fundamental frequency of voiced speech for a typical adult male.

Each of the plurality of frequencies can be different frequencies played from the speaker 405 simultaneously and/or a portion of the each of the plurality of frequencies can be the same frequency. In another aspect, each of the plurality of frequencies can be played at different time intervals. When each frequency is played at different time intervals, each frequency can correspond to an individual pulse, or a mechanical pressure wave generated by the sound from the speaker 405. Each pulse from the speaker 405 can be offset by a predetermined amount of time relative to one or more of the other pulses generated by the speaker 405. Therefore, the sound generated by the speaker 405 can be a combination of a plurality of mechanical pressure waves generated at different times and frequencies.

The predetermined sound can be played at predetermined intervals for each of the speakers 405 in each of the one or more extinguishers 110. The intervals could be simultaneous for each of the one or more extinguishers 110. Alternatively, or additionally, one or more extinguishers 110 can be configured to play the predetermined sound offset by a predetermined amount of time relative to one or more of the other extinguishers 110. The determination of which of the one or more extinguishers 110 will be offset by the predetermined amount of time relative to one or more other extinguishers 110 can be based on the position of each of the one or more extinguishers 110. For example, one or more extinguishers 110 on a wall of the area 305 can play the predetermined sound via the speaker 405 in response to detection of the fire related event 310, and an extinguisher 110 on the ceiling of the area 305 can play the predetermined sound, in response to the detection of the fire related event 310, simultaneously or offset by a predetermined amount of time relative to the extinguisher 110 on the wall of the area 305.

The predetermined sound played by the speaker 405 in each of the one or more extinguishers 110, and therefore the sound waves created by the speakers 405, can be aimed at the fire related event 310 to manipulate the fire related event 310 with physical forces such as sound waves, for example. The sound can increase air velocity, which can then thin the area of the fire related event 310 where combustion occurs. After the boundary is thinned, the flame can be extinguished more easily. In addition, the sound can disturb the fuel for the fire related event 310 and create higher fuel vaporization. The increased fuel vaporization can widen the flame to cool the flame and reduce concentration of the flame, thereby allowing the flame to be extinguished more easily.

The dimensions of the extinguisher 110 include various lengths of portions of the extinguisher 110 and an angle at which the portions of the extinguisher 110 connect. The dimensions can be proportional such that various values for length (e.g., "x") and predetermined angles at which the portions of the extinguisher 110 connect create differently sized extinguishers 110 while maintaining the carefully engineered shape to radiate sound evenly in the direction in which the extinguisher 110 is aiming. For example, length 410 can be a value for "x". Based on the value for "x", length 415 can be twice the length of "x" (i.e., "2x"). Additionally, angle 420 can correspond to a predetermined value of 160 degrees, while angles 425 can correspond to a predetermined value of 10 degrees. Axis 430 depicts a center axis of the extinguisher 110. Axis 430 indicates that the extinguisher 110 is symmetrical. For example, the angles 420 and 425 can be mirrored relative to the axis 430 such that the side diametrically opposite of angles 420 and 425 can have the same shape and angles. Therefore, any sized extinguisher 110 can be made using a value for "x" and connecting predetermined portions of the extinguisher 110 at an angle of 160 degrees. The value of "x" can correspond to the width of the speaker 405 plus a predetermined amount of space to secure the speaker 405 (e.g., 5 cm). For example, "x" can be the width of the speaker 405 plus five centimeters.

The extinguisher 110 can be light weight and portable. In one aspect, the sensors 135 can be disposed on the extinguisher 110. Additionally, the processing circuitry can be coupled to the extinguisher 110 such that the extinguisher 110 can be a stand-alone, portable sound waves fire extinguisher including any functionality of the system 100 as described herein.

Figure 5:
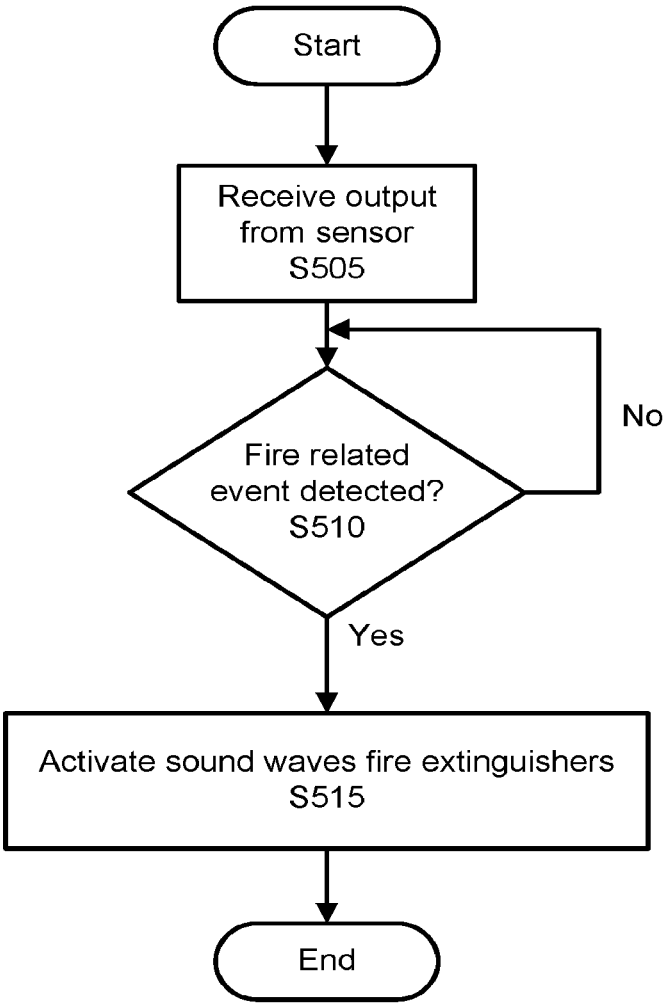
FIG. 5 is a flow chart of a method for operating a sound waves fire extinguisher according to one or more aspects of the disclosed subject matter.

FIG. 5 is a flow chart of a method for activating the system 100 according to one or more aspects of the disclosed subject matter.

In S505, output from one or more sensors 135 can be received. The sensors 135 can include one or more smoke detectors 205, one or more heat detectors 210, one or more electro-optical detectors 215, and/or one or more image-based sensors 220.

In S510, it can be determined if a fire related event 310 is detected. The sensors 135 can detect one or more fire related events 310 including smoke, heat, flames, and/or any indication that a fire related event 310 is currently occurring. If no fire related event 310 is detected, then the process can return to S510 and continue to determine if a fire related event 310 is detected. However, if there is a fire related event 310 detected, one or more extinguishers 110 can be activated in the system 100 in S515.

In S515, one or more extinguishers 110 can be activated in response to the sensors 135 detecting a fire related event 310. When the one or more extinguishers 110 are activated, the process can end.

Figure 6:
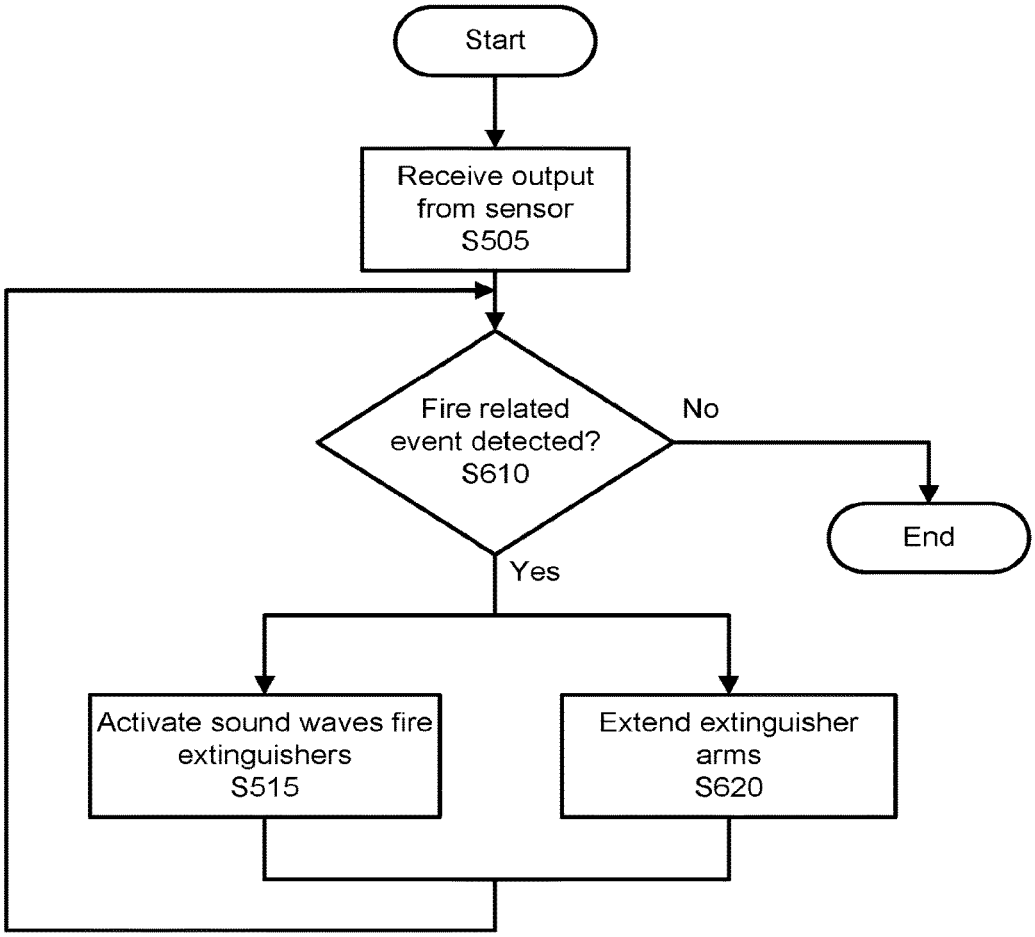
FIG. 6 is a flow chart of a method for a sound waves fire extinguisher according to one or more aspects of the disclosed subject matter.

FIG. 6 is a flow chart of a method for extending extinguisher arms 315 for extinguishers 110 in the system 100 according to one or more aspects of the disclosed subject matter.

In FIG. 6, S505 and S515 can be the same steps as described in FIG. 5.

However, if there is no fire related event 310 detected in S610, the process can end. If there is a fire related event 310 detected in S610, then then one or more extinguishers 110 can be activated in S515 and/or one or more extinguisher arms 315 can be extended in S620.

In S620, extinguisher arms 315 can be extended in response to detection of a fire related event 310 in S510. Each of the one or more extinguishers 110 can include a corresponding extinguisher arm 315. However, a predetermined number of extinguisher arms 315 could be extended based on the position of the fire related event 310. For example, eighty percent of the extinguisher arms 315 may be extended based on the position of the fire related event 310. Each extinguisher arm 315 can extend a predetermined amount such that each extinguisher arm 315 is staggered, for example, or extended the same amount. The extension of the extinguisher arms 315 can allow the extinguishers 110 to move closer to the fire related event 310, thereby increasing effectiveness via increased air speed from the sound emitted from the extinguisher 110, for example. When the extinguishers 110 are activated in S515 and the extinguisher arms 315 are activated in S620, the process can return to S610 to determine if any fire related event 310 is detected. If there is not a fire related event 310 detected in S610, then the process can end and the extinguishers 110 can be turned off and the extinguisher arms 315 can be retracted.

It should be appreciated that S515 and S620 can occur simultaneously, independently, and/or in any order according to one or more aspects of the disclosed subject matter.

An advantage of the system 100 is reduced cost by using a standard speaker (e.g., loud speakers) to play at 125 Hz as opposed to a more specialized speaker, such as a subwoofer, that specializes in playing lower frequencies (e.g., 20 Hz-60 Hz).

Additionally, the time it takes to extinguish the fire related event 310 can be reduced while also increasing the range of the extinguisher 110. For example, when the extinguisher 110 is seventy-five centimeters from a fire related event 310, a minimum extinguishing time of two seconds has been realized. The extinguishing time can be reduced further by increasing the volume of speaker 405.

The weight of the extinguisher 110 can also be reduced to be in a range of 2-5 Kg. The reduced weight allows for increased portability for the extinguisher 110 as a stand-alone sound waves fire extinguisher. However, it could be considered that the extinguishers 110 can be made larger.

Additionally, the use of system 100 can prevent further damage caused by a sprinkler system, water used by firemen, chemicals/foam from traditional fire extinguishers, and the like by using the one or more extinguishers 110 and extinguisher arms 315 to minimize any fire related event 310.

Figure 7:
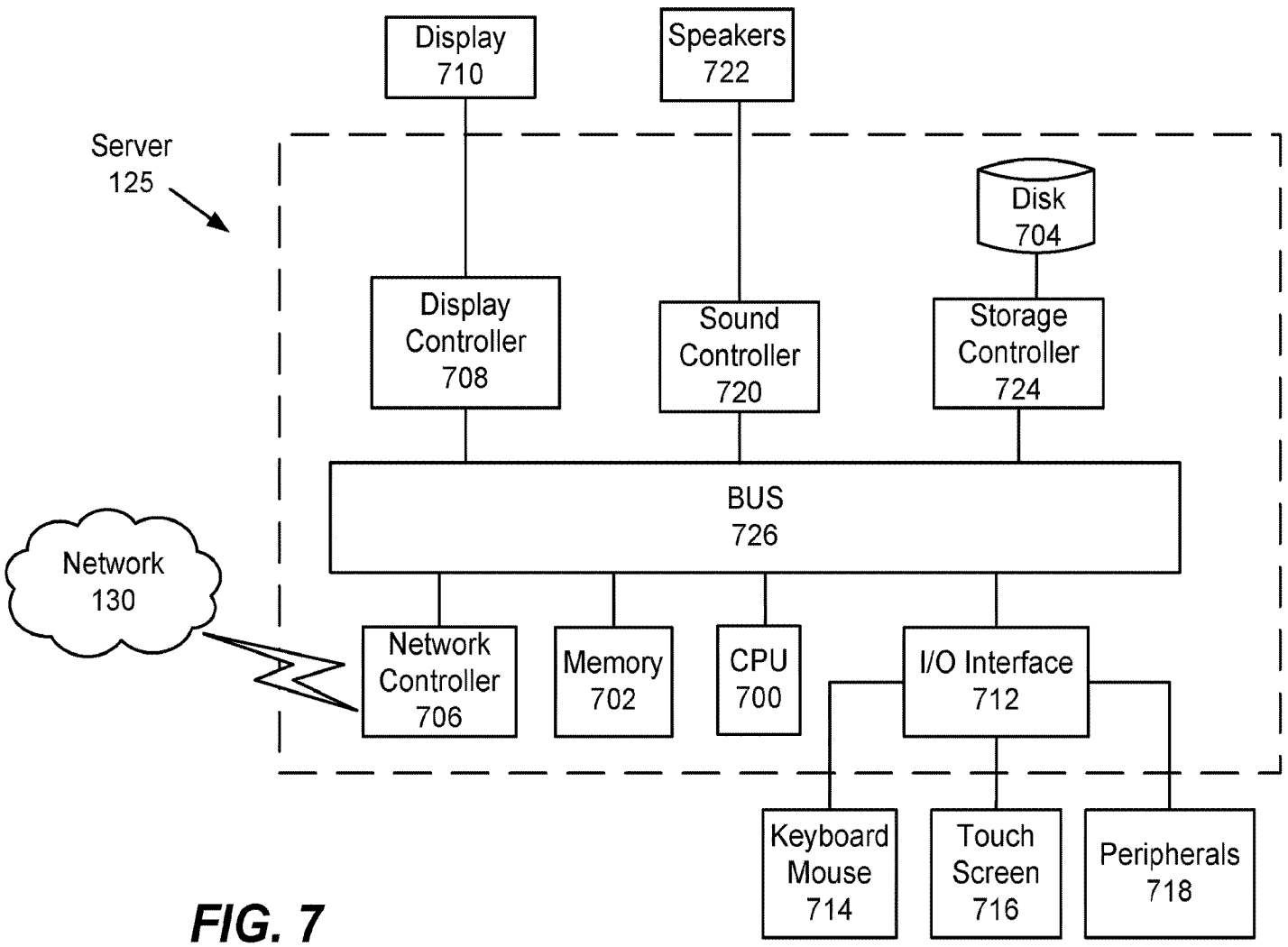
FIG. 7 is a hardware block diagram of a server according to one or more exemplary aspects of the disclosed subject matter.

Next, a hardware description of the server 125 and/or computer 115 according to exemplary aspects is described with reference to FIG. 7. In FIG. 7, the server 125 and/or computer 115 includes a CPU 700 which performs the processes described above/below. The process data and instructions may be stored in memory 702. These processes and instructions may also be stored on a storage medium disk 704 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the server 125 and/or computer 115 communicates, such as a server or computer.

Further, the functionality of the system 100 and/or extinguisher 110 may be provided as a utility application, background daemon, or component of an operating system, or combination thereof, executing in conjunction with CPU 700 and an operating system such as Microsoft Windows 7, UNIX, Solaris, LINUX, Apple MAC-OS and other systems known to those skilled in the art.

The hardware elements in order to achieve the server 125 and/or computer 115 may be realized by various circuitry elements, known to those skilled in the art. For example, CPU 700 may be a Xenon or Core processor from Intel of America or an Opteron processor from AMD of America, or may be other processor types that would be recognized by one of ordinary skill in the art. Alternatively, the CPU 700 may be implemented on an FPGA, ASIC, PLD or using discrete logic circuits, as one of ordinary skill in the art would recognize. Further, CPU 700 may be implemented as multiple processors cooperatively working in parallel to perform the instructions of the inventive processes described above.

The server 125 and/or computer 115 in FIG. 7 also includes a network controller 706, such as an Intel Ethernet PRO network interface card from Intel Corporation of America, for interfacing with the network 130.

The server 125 and/or computer 115 further includes a display controller 708, such as a NVIDIA GeForce GTX or Quadro graphics adaptor from NVIDIA Corporation of America for interfacing with display 710, such as a Hewlett Packard HPL2445w LCD monitor. A general purpose I/O interface 712 interfaces with a keyboard and/or mouse 714 as well as a touch screen panel 716 on or separate from display 710. General purpose I/O interface also connects to a variety of peripherals 718 including printers and scanners, such as an OfficeJet or DeskJet from Hewlett Packard.

A sound controller 720 is also provided in the server 125 and/or computer 115, such as Sound Blaster X-Fi Titanium from Creative, to interface with speakers/microphone 722 thereby providing sounds and/or music.

A general purpose storage controller 724 connects the storage medium disk 704 with communication bus 726, which may be an ISA, EISA, VESA, PCI, or similar, for interconnecting all of the components of the server 125 and/or computer 115. A description of the general features and functionality of the display 710, keyboard and/or mouse 714, as well as the display controller 708, storage controller 724, network controller 706, sound controller 720, and general purpose I/O interface 712 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset.

Moreover, the present disclosure is not limited to the specific circuit elements described herein, nor is the present disclosure limited to the specific sizing and classification of these elements. For example, the skilled artisan will appreciate that the circuitry described herein may be adapted based on changes on battery sizing and chemistry, or based on the requirements of the intended back-up load to be powered.

The functions and features described herein may also be executed by various distributed components of a system. For example, one or more processors may execute these system functions, wherein the processors are distributed across multiple components communicating in a network. The distributed components may include one or more client and server machines, which may share processing, in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

Having now described aspects of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other aspects (e.g., combinations, rearrangements, etc.) are enabled by the present disclosure and are within the scope of one of ordinary skill in the art and are contemplated as falling within the scope of the disclosed subject matter and any equivalents thereto. Features of the disclosed aspects can be combined, rearranged, omitted, etc., within the scope of the invention to produce additional aspects. Furthermore, certain features may sometimes be used to advantage without a corresponding use of other features. Accordingly, Applicant(s) intend(s) to embrace all such alternatives, modifications, equivalents, and variations that are within the spirit and scope of the disclosed subject matter.

The invention claimed is:

1. A sound waves fire extinguisher system, comprising:

a plurality of sound waves fire extinguishers, wherein each of the plurality of sound waves fire extinguishers includes a speaker, wherein the speaker is configured to play a predetermined sound at a predetermined frequency, and play the predetermined sound at a predetermined interval at each of the plurality of sound waves fire extinguishers, wherein the predetermined interval occurs at the same time at each of the one or more sound waves fire extinguishers or the predetermined interval is offset by a predetermined amount of time at at least one of the plurality of sound waves fire extinguishers with respect to another of the plurality of sound waves fire extinguishers; and processing circuitry configured to receive output from one or more sensors, determine if a fire related event is detected based on the output from the one or more sensors, and activate the speaker of each of the plurality of sound waves fire extinguishers in response to detection of the fire related event to minimize the fire related event via mechanical pressure waves.

2. The sound waves fire extinguisher system of claim 1, wherein the processing circuitry is configured to extend the one or more sound waves fire extinguishers to a predetermined distance from the fire related event via an extinguisher arm connected to the one or more sound waves fire extinguishers.

3. The sound waves fire extinguisher system of claim 2, wherein the predetermined distance is seventy-five centimeters from the fire related event.

4. The sound waves fire extinguisher system of claim 1, wherein the one or more sensors include one or more of smoke detectors, heat detectors, electro-optical detectors, and image-based sensors.

5. The sound waves fire extinguisher system of claim 1, wherein the fire related event includes one or more of an amount of smoke greater than a predetermined amount of smoke, an amount of heat greater than a predetermined amount of heat, and one or more flames of fire.

6. The sound waves fire extinguisher system of claim 1, wherein the sound waves fire extinguisher includes a first portion corresponding to a first length and a second portion corresponding to a second length, the second length being twice as long as the first length, and the first portion and the second portion connecting at an angle of 160 degrees.

7. The sound waves fire extinguisher of claim 1, wherein the predetermined sound is a plurality of human voices played at the predetermined frequency of 125 Hz.

8. A method of extinguishing a fire related event via a fire extinguisher, comprising:

receiving output from one or more sensors;

determining, via processing circuitry, if a fire related event is detected based on the output from one or more sensors; and activating one or more sound waves fire extinguishers in response to detection of the fire related event to minimize the fire related event via mechanical pressure waves, wherein activating each of the one or more sound waves fire extinguishers includes activating a speaker, wherein activating the speaker includes playing a predetermined sound at a predetermined frequency, wherein the predetermined sound is played at a predetermined interval at each of the one or more sound waves fire extinguishers, wherein the predetermined interval occurs at the same time at each of the one or more sound waves fire extinguishers or the predetermined interval is offset by a predetermined amount of time at one of the one or more sound waves fire extinguishers with respect to another of the one or more sound waves fire extinguishers.

9. The method of claim 8, further comprising:

extending the one or more sound waves fire extinguishers to a predetermined distance from the fire related event via an extinguisher arm connected to the one or more sound waves fire extinguishers.

10. The method of claim 9, wherein the predetermined distance is seventy-five centimeters from the fire related event.

11. The method of claim 8, wherein receiving outputs from the one or more sensors includes receiving output from one or more of smoke detectors, heat detectors, electro-optical detectors, and image-based sensors.

12. The method of claim 8, wherein the fire related event includes one or more of an amount of smoke greater than a predetermined amount of smoke, an amount of heat greater than a predetermined amount of heat, and one or more flames of fire.

13. The method of claim 8, wherein the sound waves fire extinguisher includes a first portion corresponding to a first length and a second portion corresponding to a second length, the second length being twice as long as the first length, and the first portion and the second portion connecting at an angle of 160 degrees.

14. The method of claim 8, wherein playing the predetermined sound at the predetermined frequency includes playing a plurality of human voices played at the predetermined frequency of 125 Hz.

* * * * *